United States Patent [19]

Franklin, Jr.

[11] 4,376,511

[45] Mar. 15, 1983

[54] $CO_2$ SNOW FORMING COPPER LINE

[76] Inventor: Paul R. Franklin, Jr., 5211 W. Beaver St., Jacksonville, Fla. 32205

[21] Appl. No.: 249,897

[22] Filed: Apr. 1, 1981

[51] Int. Cl.[3] ..... A01G 15/00

[52] U.S. Cl. ..... 239/14; 239/499; 239/520

[58] Field of Search ..... 239/14, 499, 520, 524, 239/559; 62/121, 165

[56] References Cited

U.S. PATENT DOCUMENTS

| | | | |
|---|---|---|---|
| 2,978,187 | 4/1961 | Hesson | 239/499 |
| 3,932,155 | 1/1976 | Pietrucha | 62/10 |
| 4,194,689 | 3/1980 | Ash | 239/14 X |

*Primary Examiner*—John J. Love
*Assistant Examiner*—Paul A. Sobel
*Attorney, Agent, or Firm*—Harvey B. Jacobson

[57] ABSTRACT

An apparatus is provided for forming $CO_2$ snow and includes a $CO_2$ line having an outlet end and an inlet end adapted for communication with a source of liquid $CO_2$ under pressure. A snow forming head is provided and comprises a generally horizontal elongated laterally and downwardly opening channel member and a $CO_2$ discharge conduit is disposed in and extends along the channel member. The conduit includes opposite side small diameter outlet openings formed therein and spaced longitudinally therealong opening outwardly toward and spaced inward of the opposing sides of the channel member. One end of the conduit is closed and the outlet end of the $CO_2$ line is sealingly communicated with the other end of the conduit. At least the portion of the conduit having the small diameter outlet openings formed therein is of a greater internal cross-sectional area than the $CO_2$ line whereby movement of liquid $CO_2$ under pressure from the line into the greater internal cross-sectional area of the conduit will affect at least initial expansion of the $CO_2$ and subsequent discharge of the latter from the outer ends of the small diameter outlet openings will affect further expansion of the $CO_2$ resulting in a greater production of $CO_2$ snow from a given volume of liquid $CO_2$ from the aforementioned source.

7 Claims, 3 Drawing Figures

$CO_2$ SNOW FORMING COPPER LINE

BACKGROUND OF THE INVENTION

Liquid $CO_2$ is utilized to form $CO_2$ snow for the purpose of pre-chilling insulated containers in which perishables to be stored or shipped at reduced temperatures may be received. In this manner, such insulated containers may be stored or shipped over reasonably long periods of time while the contents of the containers are held at reduced temperatures independent of attendant mechanical refrigeration equipment.

At present, $CO_2$ snow is formed as a result of liquid $CO_2$ under pressure being supplied to the interior of a generally bell-shaped head or nozzle and discharged through small lateral ports from a position disposed centrally within the head toward the internal surfaces thereof. The sudden reduction of pressure of the liquid $CO_2$ results in $CO_2$ snow being formed and being discharged from the open outer end of the bell-shaped head. These bell-shaped nozzles or heads are capable of producing one pound of $CO_2$ snow for each 2-¼ to 2-½ pounds of liquid $CO_2$ supplied to the head. It may thus be seen that the weight of $CO_2$ snow produced is considerably less than half of the weight of the liquid $CO_2$ required to produce the snow.

Accordingly, a need exists for a $CO_2$ snow producing nozzle or head which will be effective to produce a greater volume of $CO_2$ snow per unit of liquid $CO_2$ utilized to produce the $CO_2$ snow.

Examples of various forms of $CO_2$ snow forming heads and other similar structures including some of the general structural and operational features of the instant invention are disclosed in U.S. Pat. Nos. 2,978,187, 3,109,296, 3,815,377, 3,861,168, 3,922,878, 3,932,155 and 4,111,362.

BRIEF DESCRIPTION OF THE INVENTION

The $CO_2$ snow forming apparatus of the instant invention utilizes merely a channel-shaped shroud containing a conduit extending longitudinally thereof and received wholly within the channel defined by the channel-shaped shroud. One end of the conduit is closed and the other end of the conduit is communicated with a suitable source of liquid $CO_2$ under pressure. The portion of the conduit disposed within the channel is provided with laterally outwardly opening and longitudinally spaced opposite side small diameter outlet openings directed toward the opposing inner sides of the channel and, most importantly, the effective internal cross-sectional area of the portion of the conduit having the small diameter lateral outlet openings formed therein is approximately twice the effective internal cross-sectional area of the input end portion of the conduit with which the associated supply of liquid $CO_2$ under pressure is communicated.

By this type of construction, the liquid $CO_2$ supplied to the snow forming head is reduced in pressure as it passes from the small inside diameter delivery line into the larger internal cross-sectional area portion of the conduit immediately prior to being finally expanded upon passing outward through the lateral outlet openings formed in and spaced longitudinally along the opposite sides of the conduit portion of the snow forming head. By effecting a two-stage reduction of pressure of the $CO_2$ supplied to the $CO_2$ snow forming head, it has been found that the production of $CO_2$ snow is increased to approximately one pound of $CO_2$ snow for each pound and three-quarters to two pounds of liquid $CO_2$ supplied to the snow forming head. Of course, this results in an increase of $CO_2$ snow of up to approximately 45%.

The main object of this invention is to provide a $CO_2$ snow forming head which will be capable of increased $CO_2$ production from a given amount of liquid $CO_2$.

Yet another object of this invention is to provide a $CO_2$ snow forming head which may be readily and inexpensively included within the $CO_2$ snow receiving compartments of various different forms of insulated storage and shipping containers.

Still another important object of this invention is to provide a $CO_2$ snow forming head which may be readily manufactured from readily available components.

A final object of this invention to be specifically enumerated herein is to provide a $CO_2$ snow forming head in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
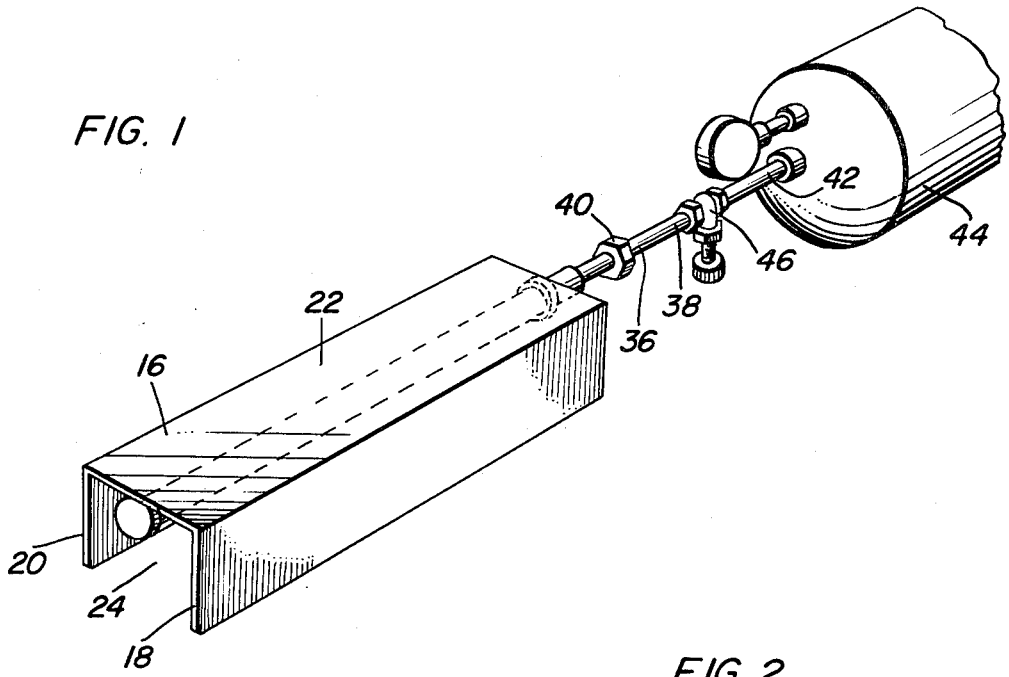
FIG. 1 is a perspective view of the $CO_2$ snow forming head of the instant invention in operative association with a source of liquid $CO_2$ under pressure.
Figure 2:
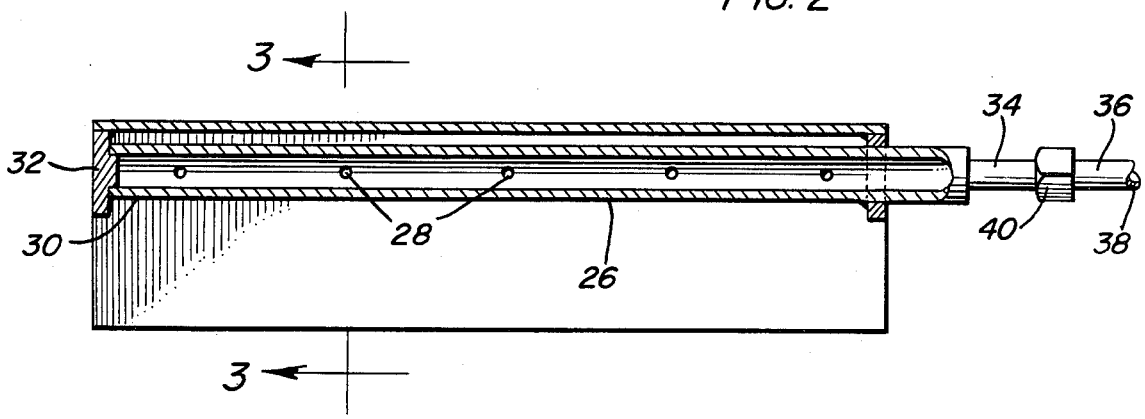
FIG. 2 is an enlarged longitudinal, vertical sectional view taken substantially upon a plane passing along the longitudinal center line of the head.
Figure 3:
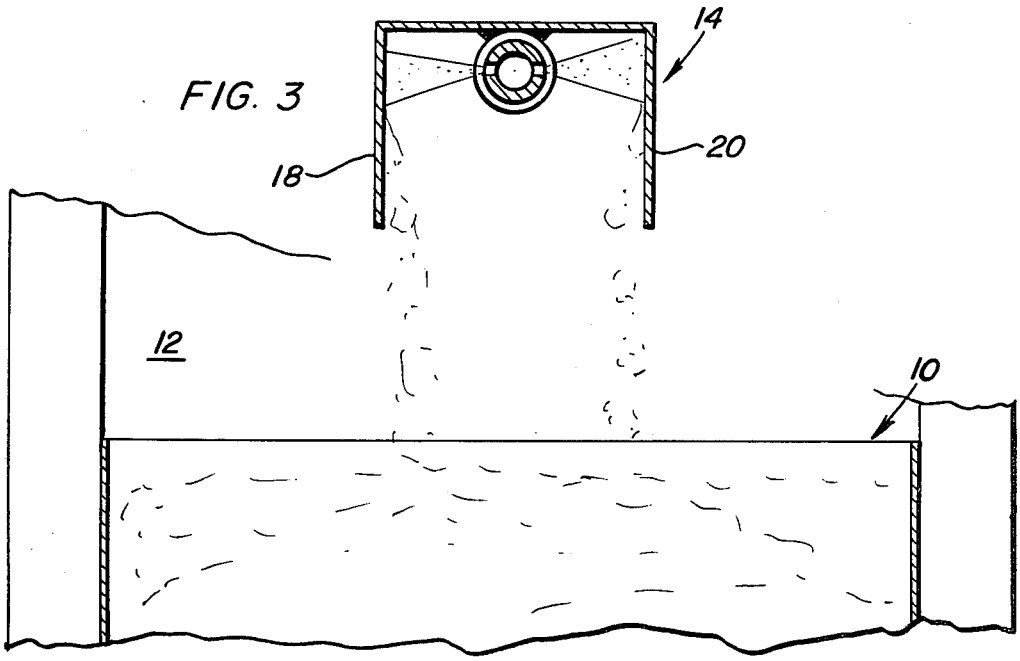
FIG. 3 is a transverse vertical sectional view taken substantially upon the plane indicated by the section line 3—3 of FIG. 2 and illustrating the manner in which the $CO_2$ snow formed within the head may readily drop into a receptacle therefor.

Referring now more specifically to the drawings, the numeral 10 generally designates a receptacle portion for receiving $CO_2$ snow and is contained within an insulated container 12. In order to fill the $CO_2$ snow receptacle portion 10, a $CO_2$ snow forming head referred to in general by the reference numeral 14 is mounted within the container 12 above the receptacle portion 10.

The head 14 comprises an elongated channel member 16 having substantially vertical opposite side flanges 18 and 20 interconnected by an upper bight portion 22 extending between the upper marginal edges of the side flanges 18 and 20.

The channel member 16 thus defines a downwardly opening channel area 24 and an elongated conduit 26 is mounted within the channel member 16 in slightly spaced relation relative to the bight portion 22 and with the conduit 26 extending longitudinally of the channel member 16. The opposite longitudinal side wall portions of the conduit 26 includes longitudinally spaced small diameter outlet openings 28 formed therein which oppose and open toward the inner surfaces of the corresponding side flanges 18 and 20.

One end 30 of the conduit 26 is closed by a plug 32 mounted within the corresponding end of the channel member 16 and the other end of the conduit 30 includes a diametrically reduced inlet end portion 34 with which the discharge end 36 of a $CO_2$ supply line 38 is sealingly communicated by a coupling 40. The inlet end 42 of the supply line 38 is communicated with a source 44 of liquid $CO_2$ under pressure and the supply line 38 may include any suitable form of valve 46 for controlling the flow of liquid $CO_2$ therethrough.

The supply line 38 and inlet end portion 34 of the conduit 26 are approximately $\frac{3}{8}$" in inside diameter and the conduit 26 is approximately $\frac{7}{8}$" in inside diameter. Accordingly, the effective internal cross-sectional area of the conduit 26 is approximately double the effective inside cross-sectional area of the supply line 38. In this manner, as $CO_2$ from the source 44 passes through the supply line and into the conduit 26, the liquid $CO_2$ will be initially expanded as it moves from the inlet end portion of the conduit 26 into the larger cross-sectional area portion of the conduit 26 in which the outlet openings 28 are formed. Thereafter, the $CO_2$ passes outwardly of the outlet openings 28 and is finally expanded and directed toward the inner surfaces of the side flanges 18 and 20 whereupon $CO_2$ snow is formed within the channel member 16 and drops down into the receptacle portion 10.

By initially expanding the $CO_2$ supplied to the conduit 26 at the inlet end of the conduit 26 and thereafter further expanding the $CO_2$ as it is discharged from the outlet openings 28, a greater amount of $CO_2$ snow is formed and received within the receptacle portion 10. As hereinbefore set forth, conventional $CO_2$ forming heads or nozzles are capable of producing approximately one pound of $CO_2$ snow for each 2-$\frac{1}{4}$ to 2-$\frac{1}{2}$ pounds of liquid $CO_2$ supplied to the snow forming head. However, with the snow forming head of the instant invention, one pound of $CO_2$ snow may be formed for each 1-$\frac{3}{4}$ to two pounds of liquid $CO_2$ provided.

The vertical height of the flanges 18 and 20 is equal to at least twice the diameter of the conduit 26, the conduit 26 is constructed of copper and the inlet end portion 34 is of substantially the same inside cross-sectional area as the inside cross-sectional area of the supply line 38.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for forming $CO_2$ snow, said apparatus including a $CO_2$ line having an outlet end and an inlet end adapted for communication with a source of liquid $CO_2$ under pressure, a snow forming head, said head comprising a generally horizontal elongated laterally and downwardly opening channel member, a $CO_2$ discharge conduit disposed in and extending along said channel member, said conduit including opposite side small diameter outlet openings formed therein and spaced longitudinally therealong opening outwardly toward and spaced inward of the opposing sides of said channel member, one end of said conduit being closed and the other end of said conduit having said outlet end sealingly communicated therewith, at least the portion of said conduit having said small diameter outlet openings formed therein being of greater internal cross-sectional area than said $CO_2$ line, whereby the movement of liquid $CO_2$ under pressure from said line into said greater internal cross-sectional area of said conduit will effect at least initial expansion of said liquid $CO_2$ and movement of $CO_2$ outwardly of the outer ends of said small diameter outlet openings will effect further expansion of the $CO_2$ and result in a greater production of $CO_2$ snow from a given volume of liquid $CO_2$ supplied from said source.

2. The combination of claim 1 wherein said channel member includes a pair of parallel side flanges interconnected by an upper generally horizontal bight portion extending between the upper marginal edge portions of said side flanges.

3. The combination of claim 2 wherein said side flanges are of a vertical height equal to at least twice the diameter of said conduit.

4. The combination of claim 1 wherein said conduit is constructed of copper.

5. The combination of claim 4 wherein said channel member includes a pair of parallel side flanges interconnected by an upper generally horizontal bight portion extending between the upper marginal edge portions of said side flanges.

6. The combination of claim 5 wherein said side flanges are of a vertical height equal to at least twice the diameter of said conduit.

7. The combination of claim 1 wherein said other end of said conduit is of substantially the same inside cross-sectional area as the inside cross-sectional area of said $CO_2$ line.

* * * * *